US008727165B2

(12) United States Patent
Nolan

(10) Patent No.: US 8,727,165 B2
(45) Date of Patent: May 20, 2014

(54) HINGE SYSTEM FOR A MODULAR BULK CONTAINER

(75) Inventor: Roger Nolan, Seymour, IN (US)

(73) Assignee: ORBIS Corporation, Oconomowoc, WI (US)

( * ) Notice: Subject to any disclaimer, the term of this patent is extended or adjusted under 35 U.S.C. 154(b) by 962 days.

(21) Appl. No.: 11/839,102

(22) Filed: Aug. 15, 2007

(65) Prior Publication Data

US 2009/0044376 A1 Feb. 19, 2009

(51) Int. Cl.

| | |
|---|---|
| ***B65D 6/00*** | (2006.01) |
| ***B65D 8/00*** | (2006.01) |
| ***B65D 51/04*** | (2006.01) |
| ***B65D 43/14*** | (2006.01) |
| ***E05D 7/04*** | (2006.01) |
| ***E05D 15/00*** | (2006.01) |

(52) U.S. Cl.
USPC ..... 220/254.5; 220/4.28; 220/845; 16/246; 16/362

(58) Field of Classification Search
USPC ..... 220/254.5, 845, 4.28; 16/246, 362
See application file for complete search history.

(56) References Cited

U.S. PATENT DOCUMENTS

| | | | | |
|---|---|---|---|---|
| 4,089,417 | A | 5/1978 | Osborne | |
| 4,349,121 | A | 9/1982 | Lafferty | |
| 4,466,541 | A | 8/1984 | Tabler et al. | |
| 4,571,774 | A * | 2/1986 | Hinson | 16/237 |
| 4,828,132 | A | 5/1989 | Francis, Jr. et al. | |
| 4,863,062 | A * | 9/1989 | Holliday | 220/845 |
| 4,967,927 | A | 11/1990 | Reiland et al. | |
| 5,094,356 | A | 3/1992 | Miller | |
| 5,199,592 | A | 4/1993 | Reiland et al. | |
| 5,535,482 | A * | 7/1996 | Grabber | 16/286 |
| 5,660,291 | A * | 8/1997 | Dash | 220/6 |
| 5,769,230 | A | 6/1998 | Koefelda | |
| 5,845,799 | A | 12/1998 | Deaton | |
| 5,938,059 | A | 8/1999 | Luburic | |
| 6,000,604 | A | 12/1999 | Lapoint, III | |

(Continued)

FOREIGN PATENT DOCUMENTS

| | | |
|---|---|---|
| EP | 0 485 672 A1 | 5/1992 |
| EP | 1 652 646 A2 | 5/2006 |

(Continued)

OTHER PUBLICATIONS

"International Search Report for PCT/US08/73306 mailed Nov. 24, 2008".

*Primary Examiner* — Anthony Stashick
*Assistant Examiner* — Andrew T Kirsch
(74) *Attorney, Agent, or Firm* — Ungaretti & Harris LLP

(57) ABSTRACT

A panel (10) for a modular bulk container is described. The panel (10) has a frame (16) and a door (18) pivotally attached to the frame (16) by a hinge (20). The frame (16) has a first frame surface defining a first imaginary plane and an opposing second frame surface defining a second imaginary plane. The door (18) has a first door surface. The hinge (20) is extendable from a portion of the frame (16). The hinge (20) has a single pivoting axis and is movable from a first position in the door closed condition wherein the hinge (20) is entirely located between the first imaginary plane and the second imaginary plane to a second position located outwardly from the first position in a door open condition wherein an angle between the first imaginary plane and the first door surface is less than 30 degrees.

6 Claims, 20 Drawing Sheets

(56) References Cited

U.S. PATENT DOCUMENTS

| | | | | |
|---|---|---|---|---|
| 6,135,287 | A | 10/2000 | Hartwall | |
| RE37,915 | E | 12/2002 | Lapoint, III | |
| 6,783,032 | B2 | 8/2004 | Fons | |
| 6,783,058 | B2 | 8/2004 | Quaintance | |
| 6,786,394 | B2 | 9/2004 | Prince | |
| 2004/0065699 | A1 | 4/2004 | Schoer et al. | |
| 2004/0256385 | A1 * | 12/2004 | Hartwall | 220/6 |
| 2005/0103797 | A1 | 5/2005 | Rader et al. | |
| 2006/0091145 | A1 | 5/2006 | Miller et al. | |
| 2007/0140684 | A1 | 6/2007 | Tsang | |

FOREIGN PATENT DOCUMENTS

| | | | |
|---|---|---|---|
| GB | 2 426 237 | A | 11/2006 |
| WO | WO-96/40564 | | 12/1996 |
| WO | WO-03/024815 | A1 | 3/2003 |

* cited by examiner

HINGE SYSTEM FOR A MODULAR BULK CONTAINER

TECHNICAL FIELD

The invention relates to modular bulk containers. More particularly, the present invention relates to a hinge system for a modular bulk container.

BACKGROUND OF THE INVENTION

Polymeric bulk containers for handling and shipping materials have found increasing use with the advent of the "just-in-time" delivery philosophy. Such containers are often produced in modular, foldable, or collapsible formats. These formats allow the bulk containers to be emptied, dissembled, folded, or collapsed, and returned while taking up a minimum amount of shipping space. To further ensure that the empty containers use the minimum amount of shipping space, the dissembled, folded, or collapsed containers are stackable having regular profiles without protruding latches, hinges, or other features.

Many of these containers include a sidewall panel having an opening closeable by a hinged door or gate. The opening is provided to allow access to the container's contents when access through the top is impractical, such as when the top is covered, when the containers are stacked, or when the container is at a height where accessing the top of the container is difficult or impossible. However, several drawbacks have been encountered in connection with such hinged doors.

For instance, many times the open door does not lie flush against the remaining portion of the panel sidewall. The door may extend outwardly at an angle which causes an obstruction to entry to the container and/or to approach to the container.

In addition, portions of hinge may protrude beyond a surface of the panel, causing instability when an adjacent panel is stacked on the surface.

Yet another drawback is the complexity of the hinges designed to overcome the drawbacks described above. One such hinge includes two pivot axes. Hinges with multiple pivot axes are difficult to manufacture, difficult to assemble, the multiple pivot axes cause instability in the door. Doors attached with such hinges have a tendency to be loose and subject to damage as the multiple pivot axes do not provide a secure connection between the open door and the remaining portions of the panel.

The present invention is provided to solve the problems discussed above and other problems, and to provide advantages and aspects not provided by prior panels of this type. A full discussion of the features and advantages of the present invention is deferred to the following detailed description, which proceeds with reference to the accompanying drawings.

SUMMARY OF THE INVENTION

A first aspect of the present invention is directed to a hinge pivotally joining a first member to a second member. The hinge has a pivot axis and an extensible plate. The pivot axis is defined by a pivot pin located between end portions of the first member and the second member. The extensible plate is attached to the first member and is selectively extendable from a first position wherein the pivot axis is located at least partially adjacent a first side of an imaginary plane defined by an outer surface of the first member to a second position wherein the pivot axis is located on an opposite side of the imaginary plane.

A second aspect of the present invention is directed to a panel for a modular bulk container. The panel comprises a first member pivotally joined to a second member by an extensible hinge. The extensible hinge may be selectively extendable from a portion of the panel along a linear path and at a substantially fixed angle thereto. The substantially fixed angle is less than or equal to 90 degrees relative to an imaginary plane parallel to an outer surface of the first member. The first member may include a slot through which a portion of the extensible hinge traverses. The slot has an angle approximately equal to the substantially fixed angle at which the extensible hinge is selectively extendable. The extensible hinge may comprise a keeper for engaging a portion of the panel to ensure attachment of the extensible hinge thereto.

Further to the second aspect of the invention, the second member may comprise an extension selectively engageable with a portion of the first member as the second member pivots on the hinge. As the extension engages the first member, the hinge extends outwardly from the first member in response to engagement between the first and second members. Alternatively, the first member may comprise an extension selectively engageable with a portion of the second member. As the second member pivots on the hinge, the extensible hinge extends outwardly from the first member in response to engagement between the first and second members.

Still further to the second aspect of the invention, the first member may comprise a cam surface engageable with a surface of the second member. The engagement between the cam surface and the surface of the second member causes reciprocal movement by the extensible hinge which increases a distance between a first end portion of the first member and a first end portion of the second member.

Still further to the second aspect of the present invention, the hinge may include a pivoting axis about which the second member rotates. The panel may further comprise a means for increasing a distance of the pivoting axis from the first member. This means for increasing the distance between of the pivoting axis form the first member is activated by engagement of the first and second members as the second member is pivoted about an axis of rotation on the hinge. A portion of the hinge may be located within a slot located on the panel wherein the slot restricts motion of the portion of the hinge to two dimensions. The hinge may comprise a tongue received within the slot located on the first member wherein the tongue traverses within the slot to extend the hinge outwardly from the first member.

A third aspect of the present invention is also directed to a panel for a modular bulk container. The panel has a door pivotally attached to a frame by a hinge. The hinge has a reciprocating extension motion increasing a distance between a first end portion of the frame and a first end portion of the door in response to engagement between a second portion of the frame and a second portion of the door. The reciprocating motion is substantially linear.

In a fourth aspect of the present invention, the frame has a first frame surface defining a first imaginary plane and an opposing second frame surface defining a second imaginary plane. The door has a first door surface. The hinge pivotally joins the door with the frame and has a single pivoting axis. The hinge is movable from a first position in the door closed condition wherein the hinge is entirely located between the first imaginary plane and the second imaginary plane to a second position located outwardly from the first position in a door open condition where an angle between the first imaginary plane and the first door surface is less than 30 degrees.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
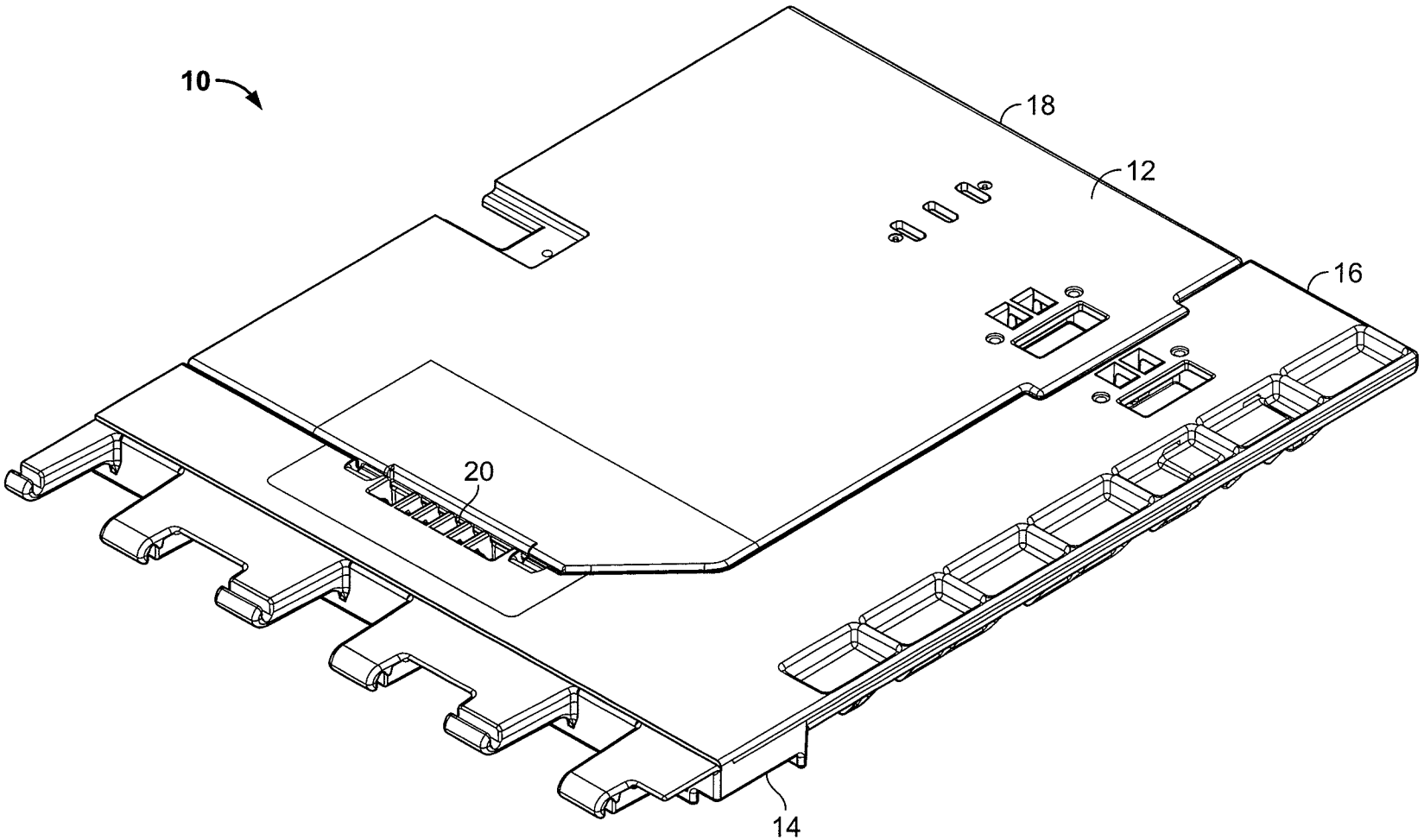
FIG. 1 is a perspective view of a panel for a bulk container.
Figure 2:
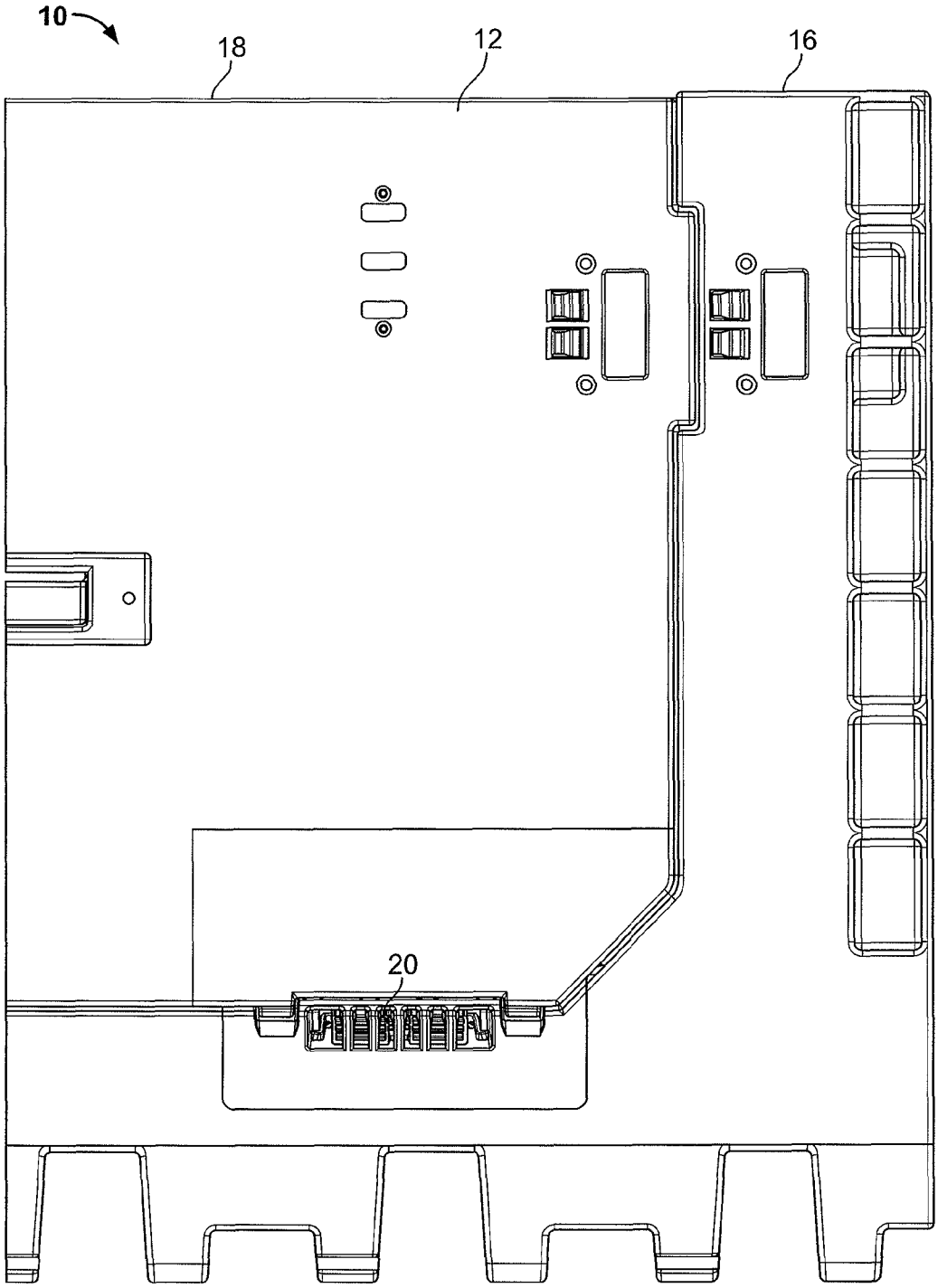
FIG. 2 is a top view of the panel of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention relates to the hinging of a door or gate on a modular, foldable, and/or collapsible container. In particular, such a container made up of a plurality of interconnected panels. Preferably, the container panels can be folded or detached from one another other such that the folded or separated panels can be stacked while occupying a minimum of space. One of the panels typically includes a door or gate for covering an opening in the panel. Preferably, the container is of a pallet type to permit transportation by a forklift, and is designed for nesting when stacked, either in the erect or collapsed configuration.

Containers of this type can be made of a number of materials. Preferably, the container is formed by injection-molded plastic techniques. The structure is most advantageously formed of a material, such as high-density polyethylene. The thickness of the sidewalls and base will be determined by the strength and durability requirements for the particular container. Ribbing or reinforcement may be provided for wall members according to principles well known in the art. Preferably, the inside surfaces of the panels are smooth and free of obstructions, so as to be easily cleaned and to prevent damage to sensitive contents.

Referring generally to FIGS. 1 through 15, a sidewall panel 10 for a modular bulk storage/transportation container of the type described above is illustrated. The panel 10 has an inner surface 12, preferably a smooth surface, and an opposing outer surface 14 which preferably includes a plurality of patterned ribbing or reinforcements 15 to strengthen the panel 10. The panel 10 comprises a frame 16 and a gate or door 18 joined to the frame 16 by a hinge 20.

Referring to FIGS. 3 through 6, when the door 18 is in a closed position, i.e. the panel 10 has a substantially planar configuration, the hinge 20 is located between the inner and outer surfaces 12,14 of the panel, such that no portion of the hinge 20 protrudes outwardly from imaginary planes defined by the inner and outer surfaces 12,14 of the panel 10. This allows multiple panels of this type to be stacked on stacking surfaces, the inner and outer surfaces 12,14 of adjacent panels 10, with maximum stability and minimal use of space. In other words, adjacently stacked panels 10 will not rock or be unstable as a result of protruding portions of the hinge 20.

Figure 4:
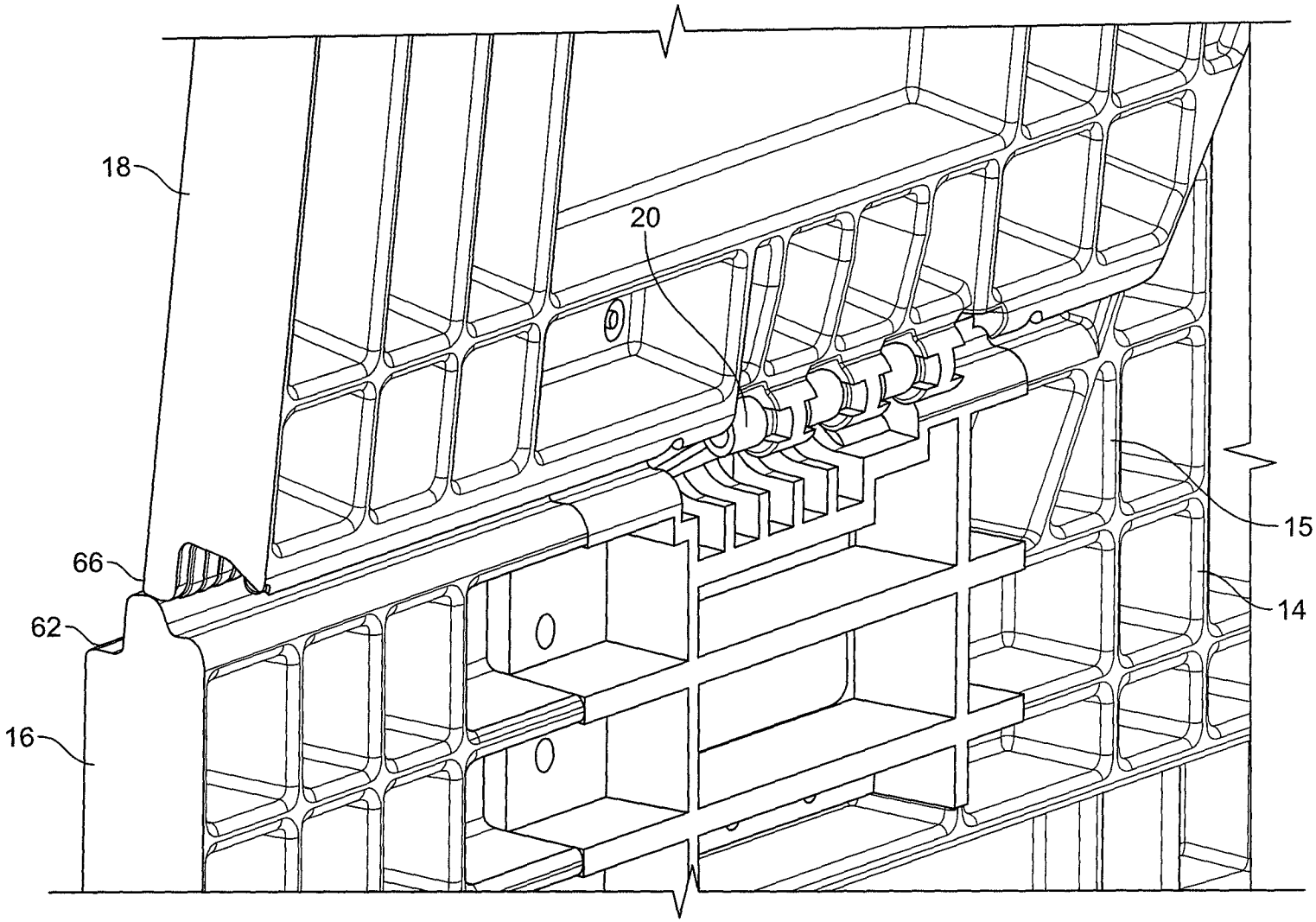
FIG. 4 is a partial perspective view of a bottom or outer surface of the panel of FIG. 3 with the door or gate slightly ajar.
Figure 5:
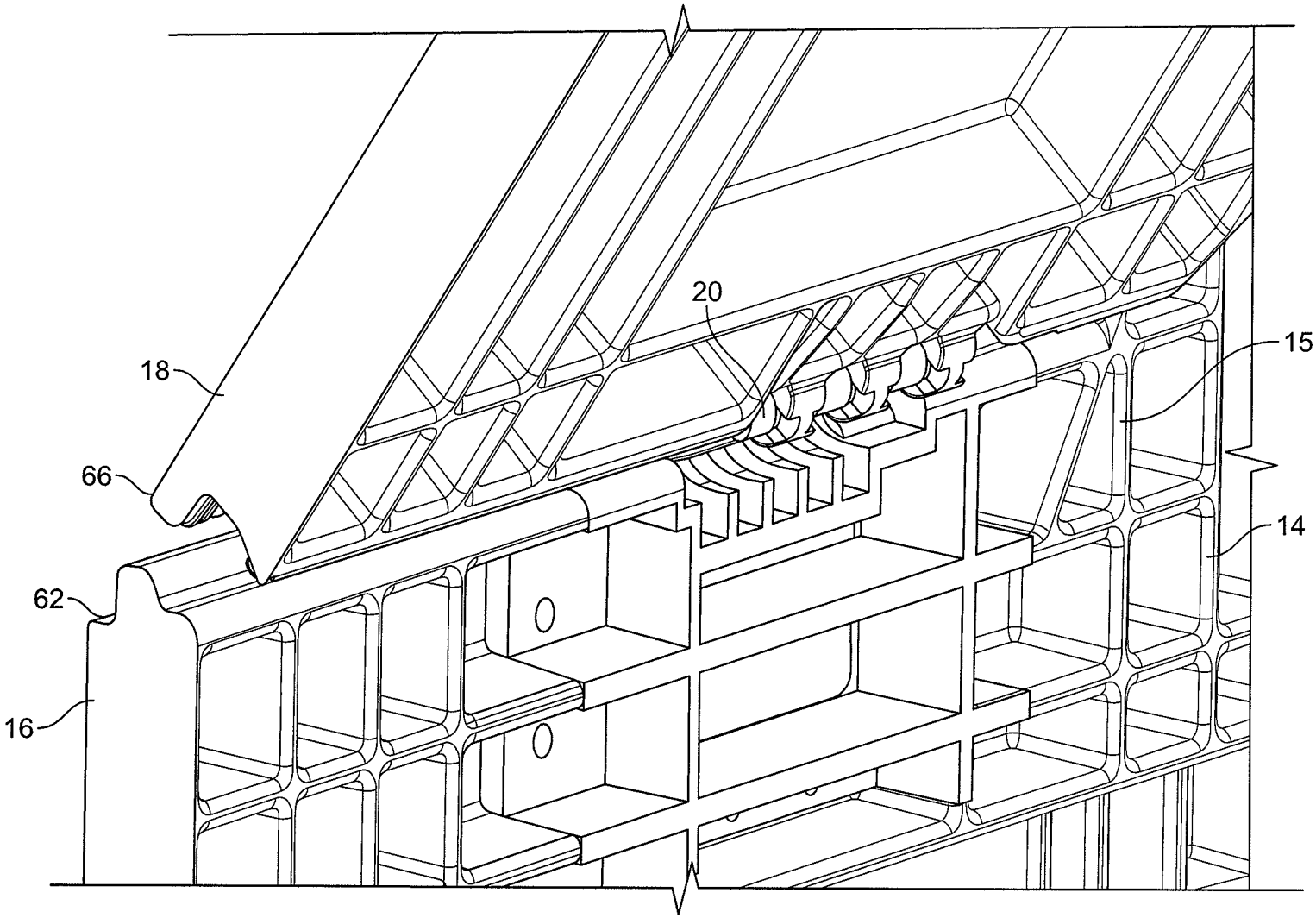
FIG. 5 is a partial perspective view of a bottom or outer surface of the panel of FIG. 3 with the door or gate partially open.
Figure 6:
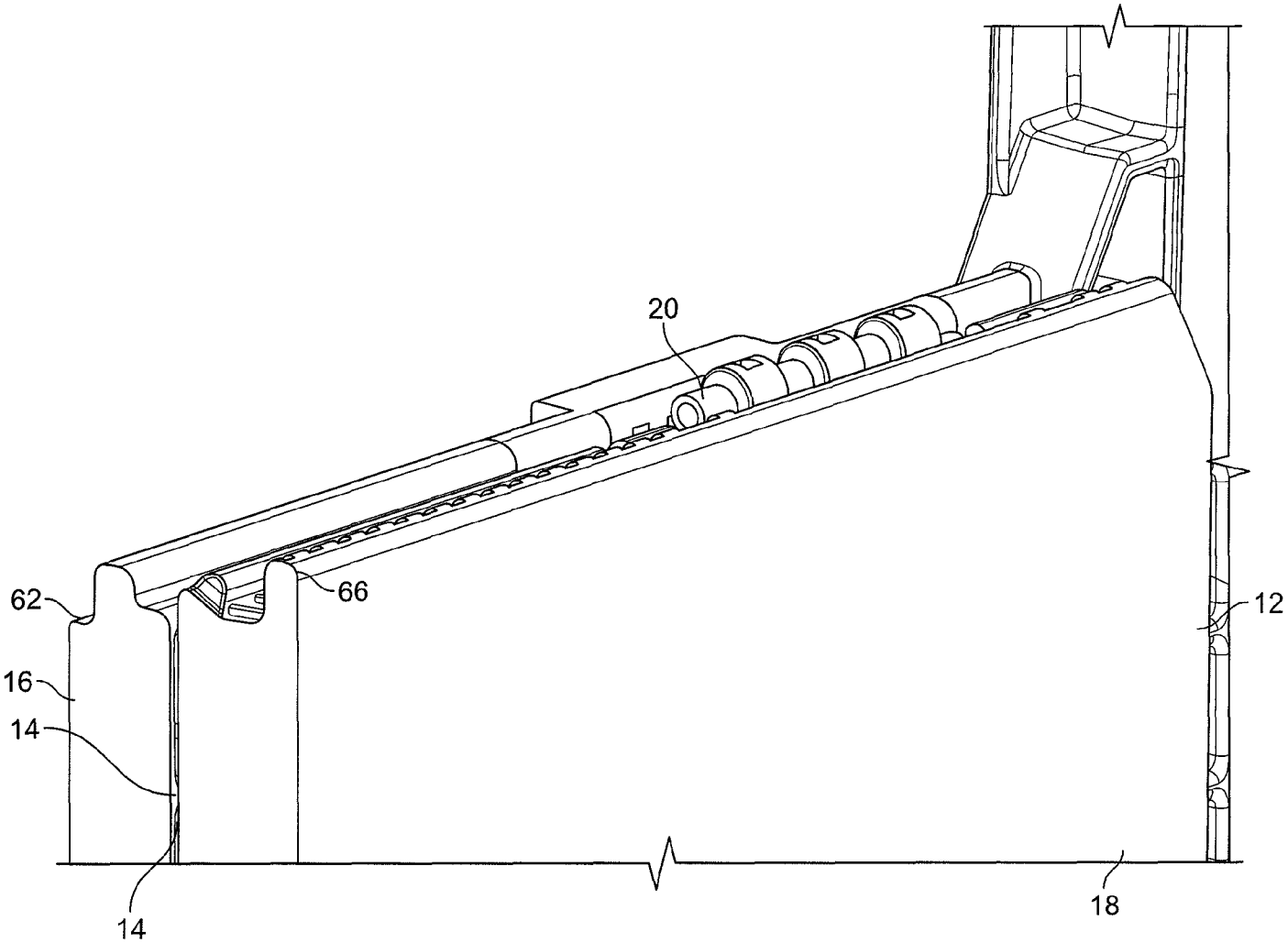
FIG. 6 is a partial perspective view of a bottom or outer surface of the panel of FIG. 3 with the door or gate in an open condition.
Figure 7:
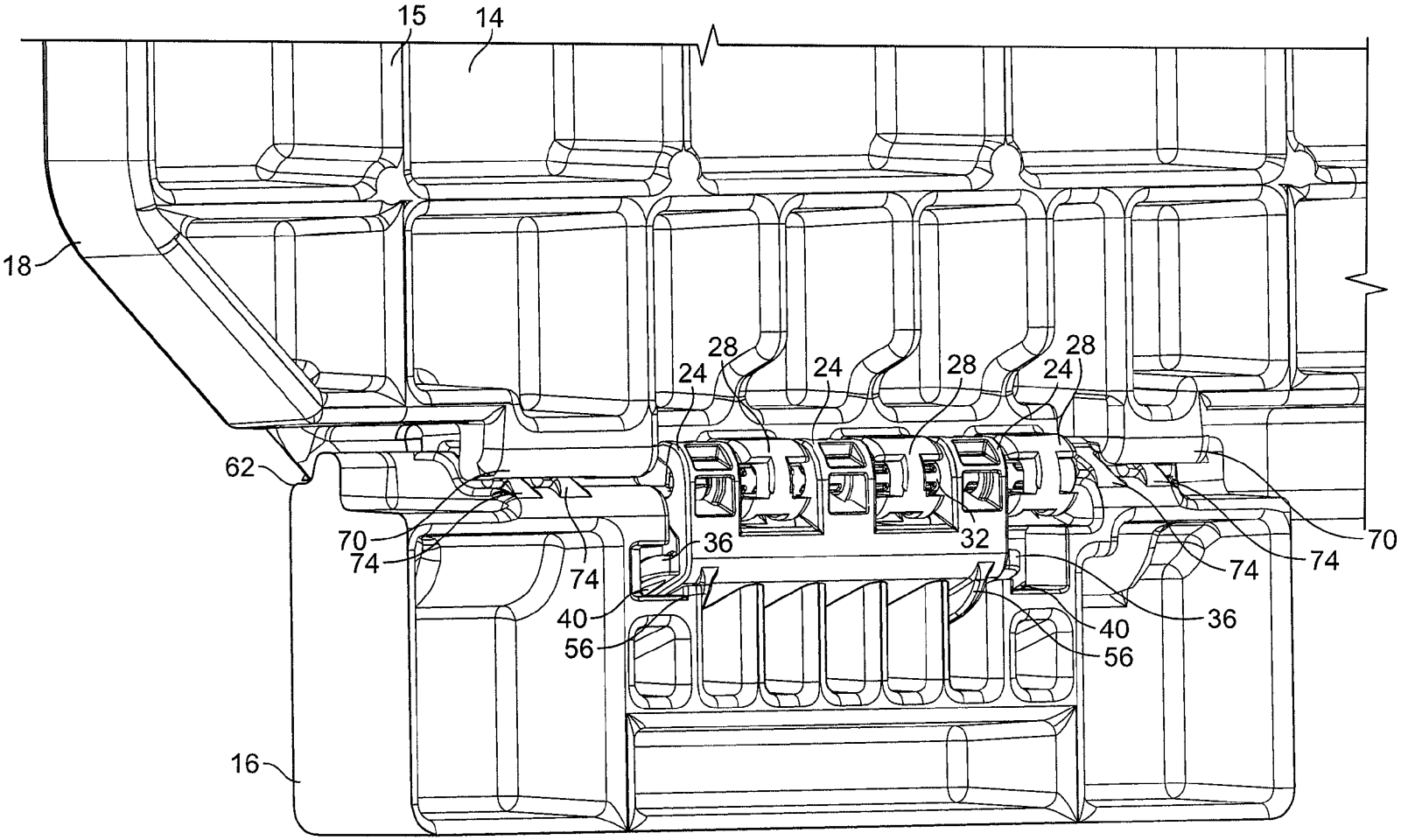
FIG. 7 is a partial perspective view of a bottom or outer surface of a panel of the present invention.
Figure 8:
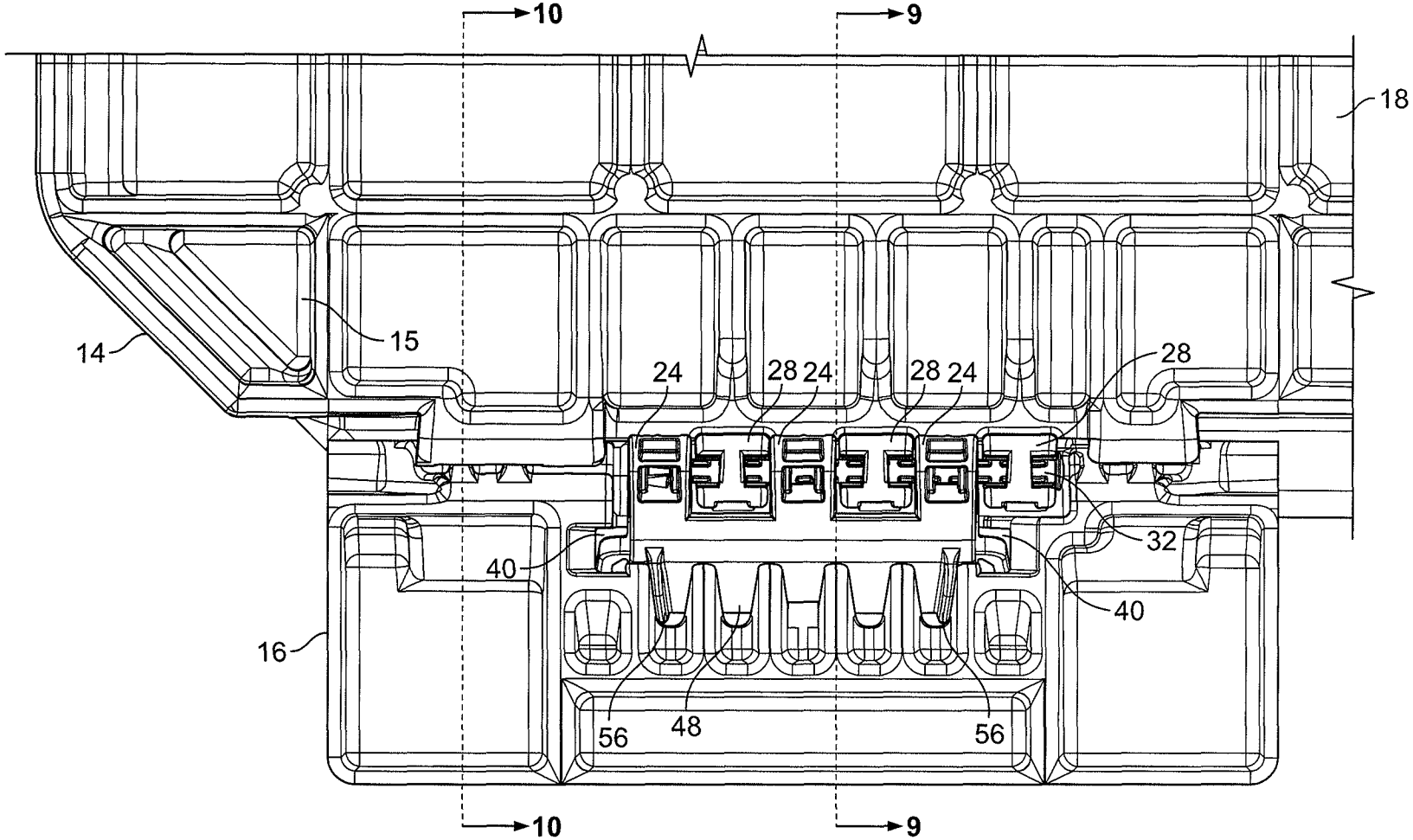
FIG. 8 is a partial bottom or outer view of a panel of the present invention.
Figure 9:
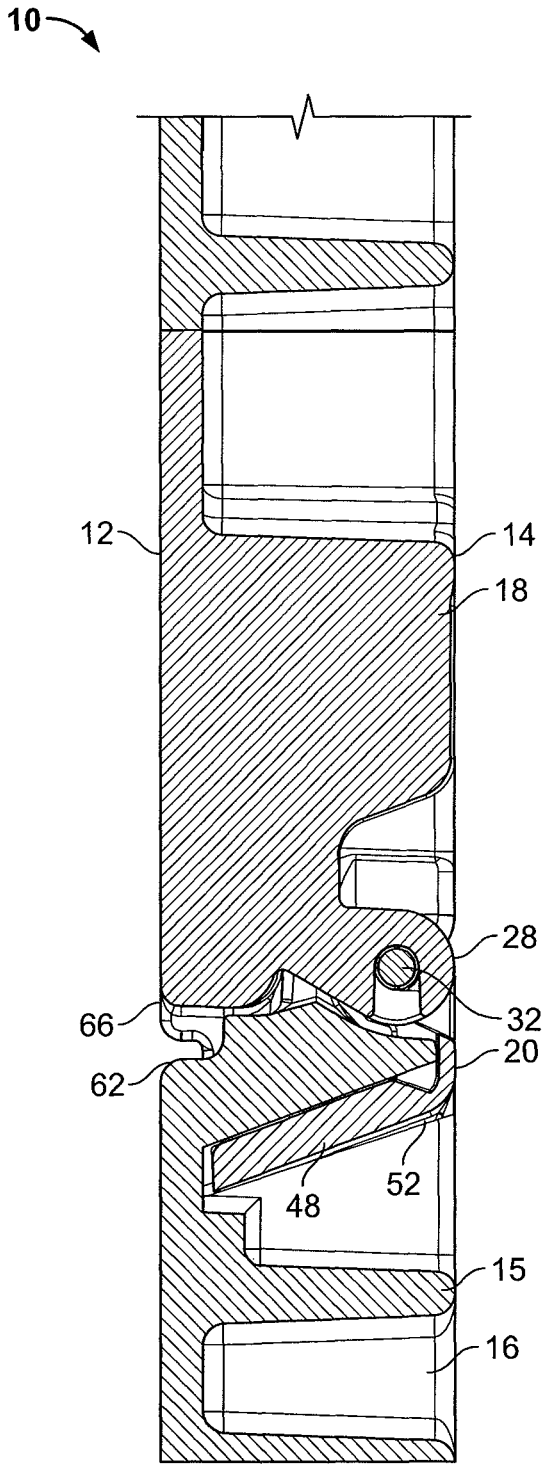
FIG. 9 is a cross-sectional view taken along 9-9 of FIG. 8.
Figure 10:
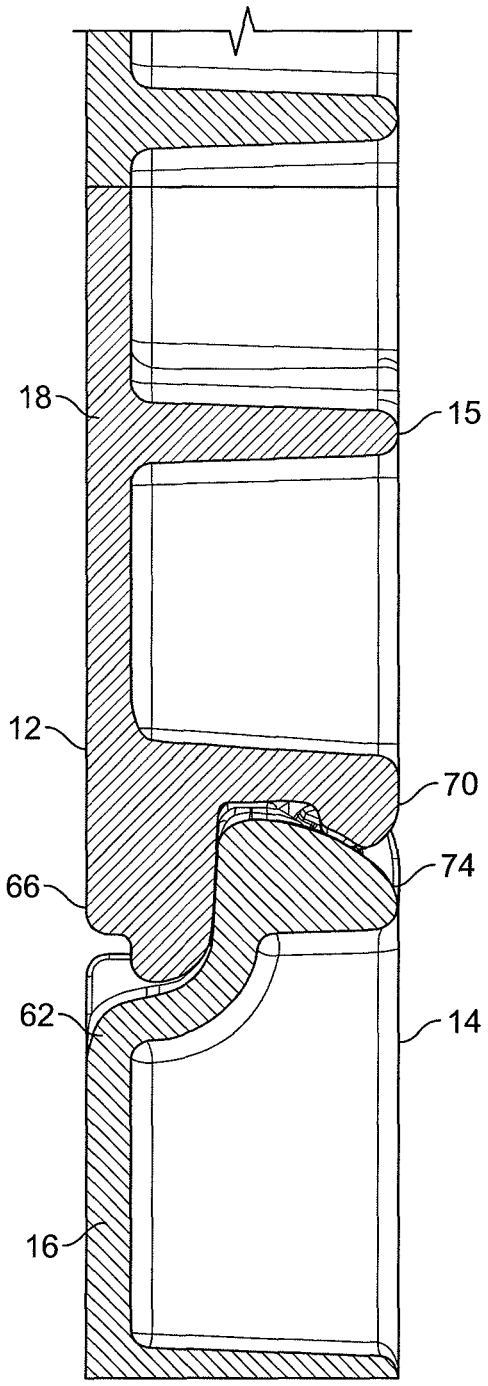
FIG. 10 is a cross-sectional view taken along 10-10 of FIG. 8.
Figure 11:
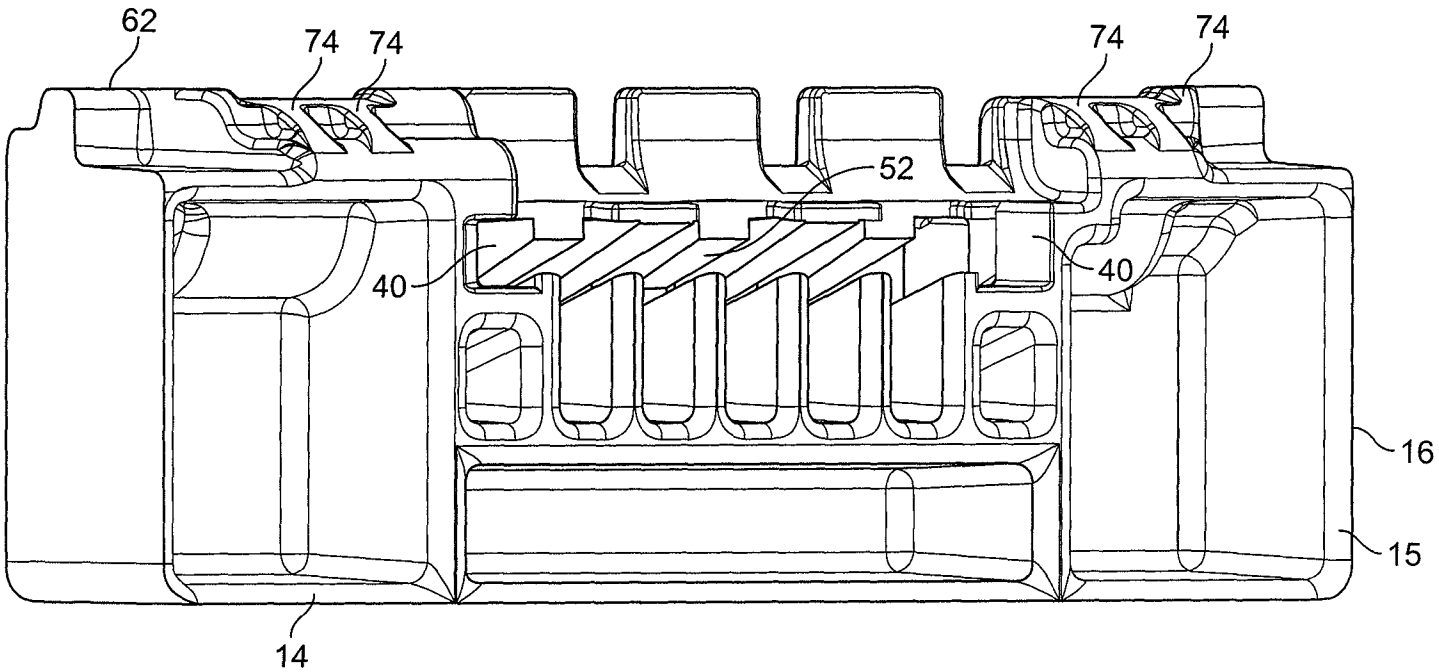
FIG. 11 is a partial perspective view of a portion of a frame to which a door is hingedly attached.
Figure 12:
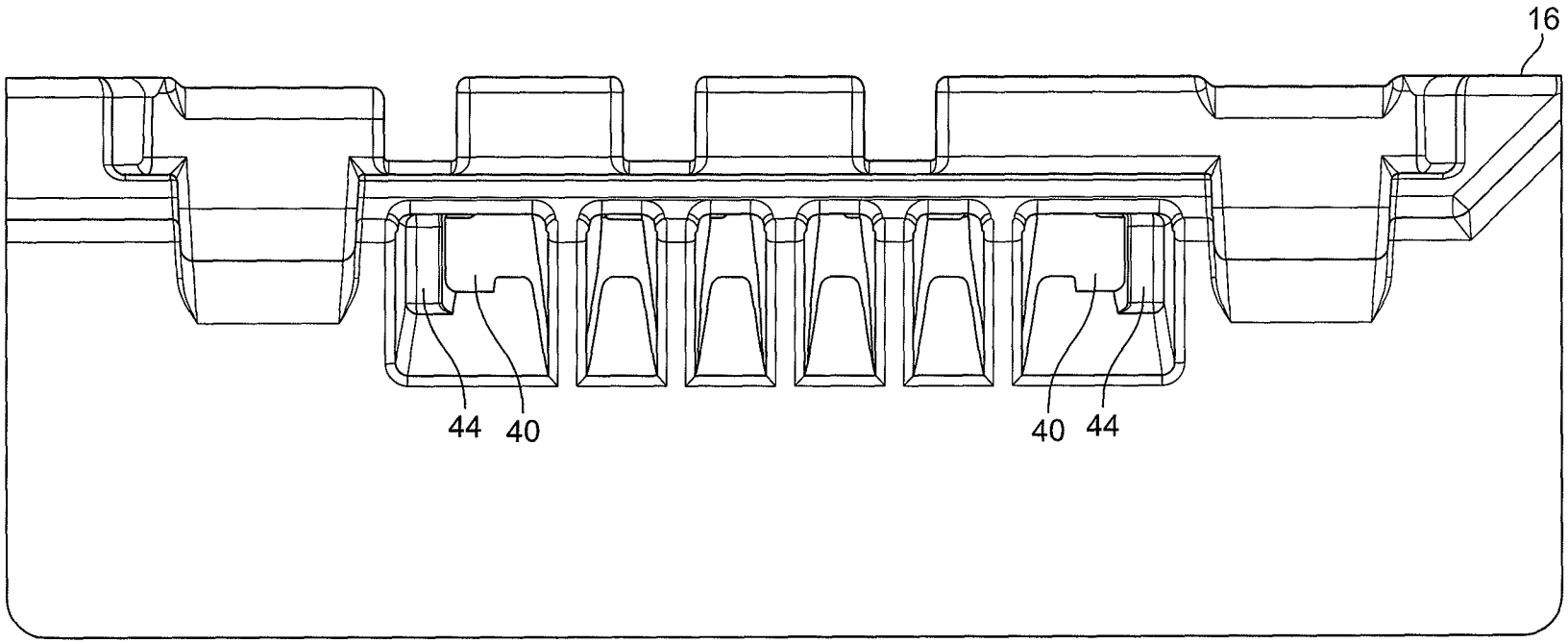
FIG. 12 is a top or inner surface view of the portion of the frame shown in FIG. 11.
Figure 13:
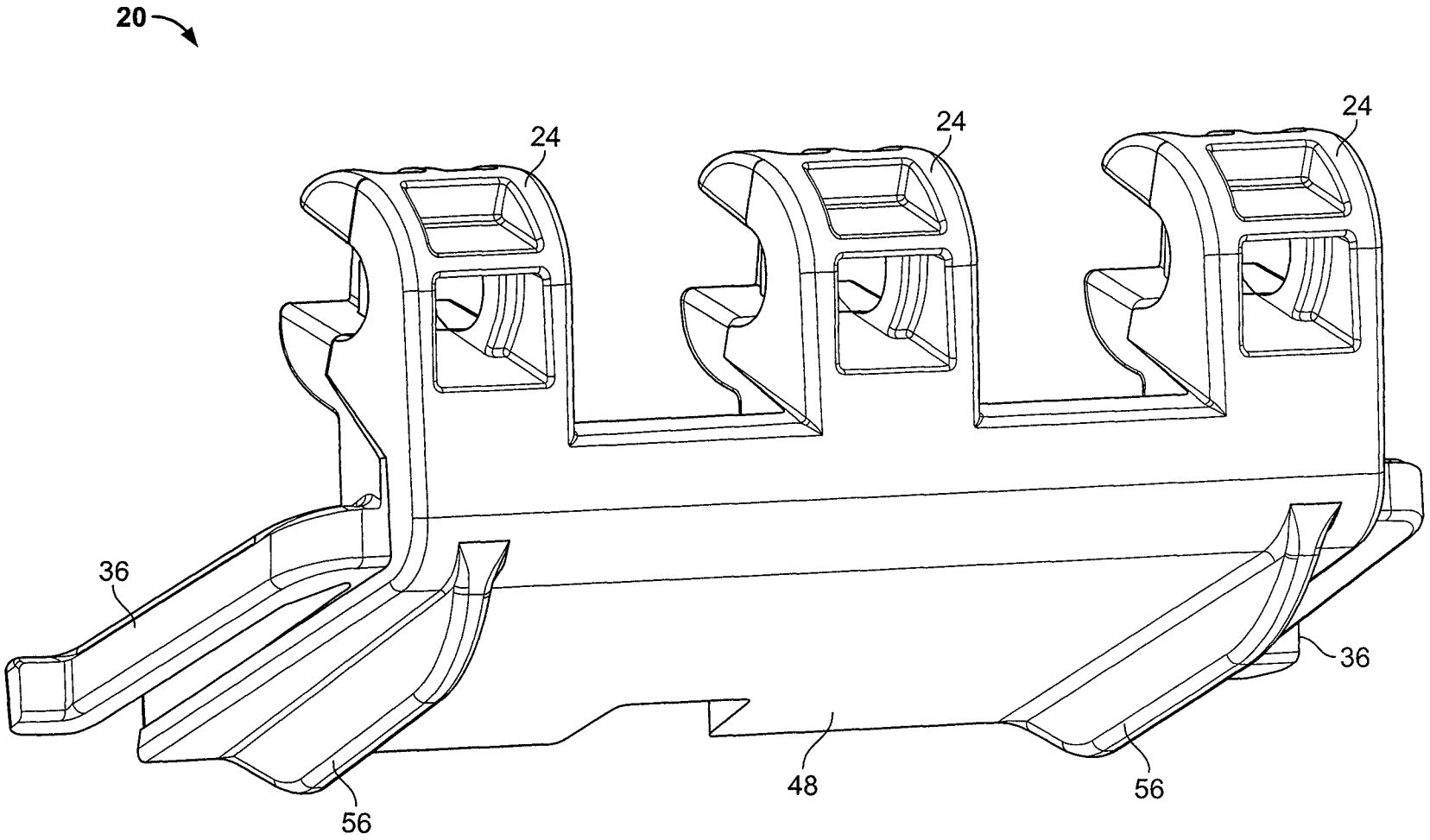
FIG. 13 is a perspective view of a rigid, slideable, articulated hinge.
Figure 14:
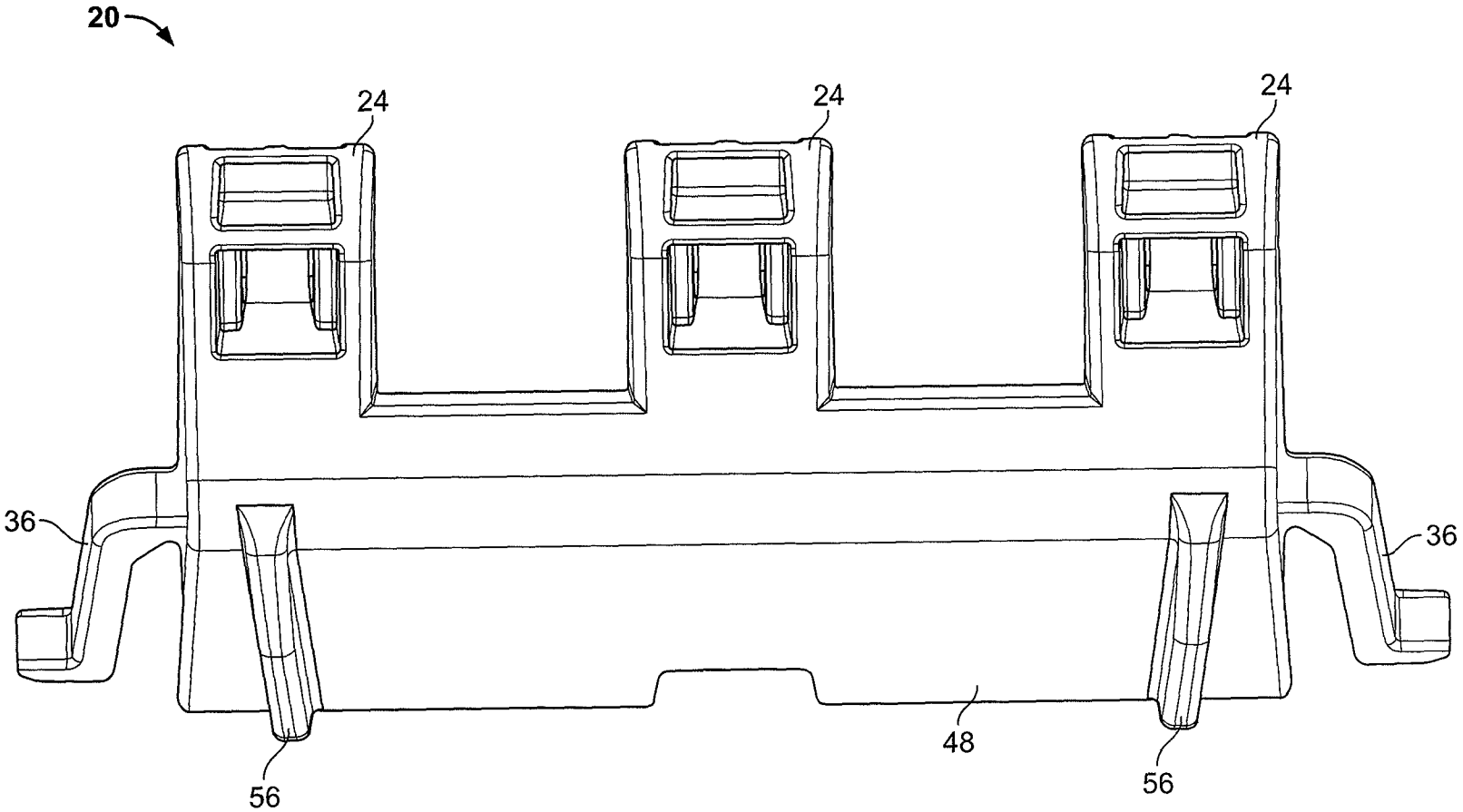
FIG. 14 is a top view of a rigid, slideable, articulated hinge.
Figure 15:
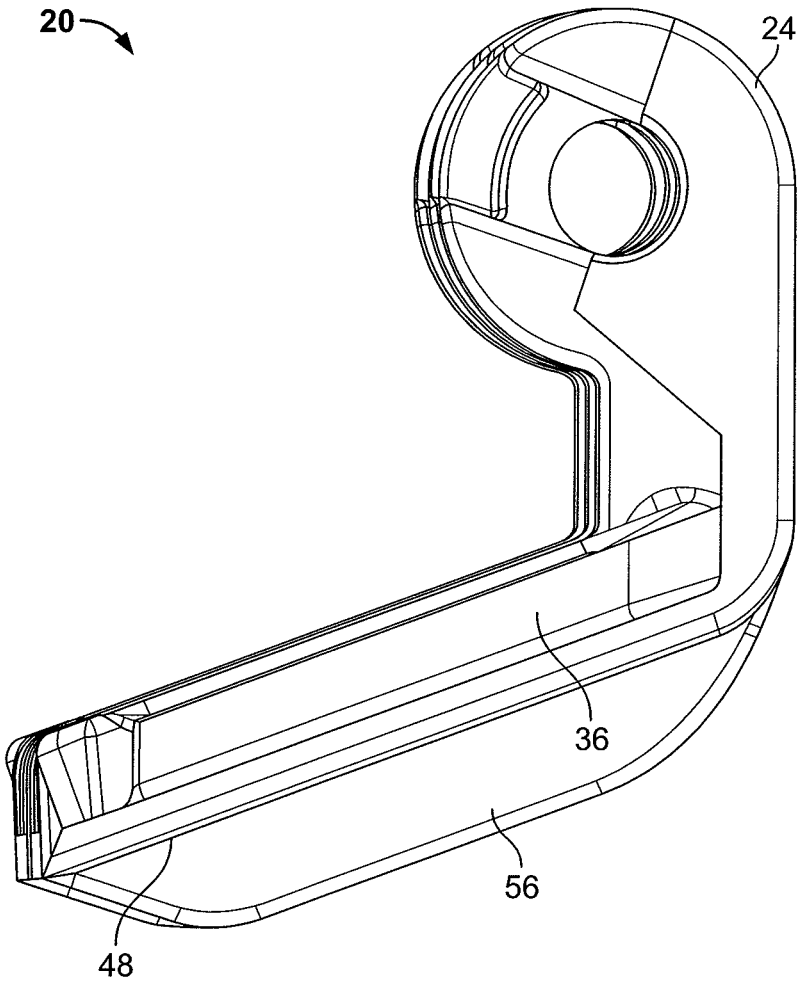
FIG. 15 is a side view of a rigid, slideable, articulated hinge.

As illustrated in FIG. 6, it is also preferable for the outer surface 14 of the door 18 to lie at a very low angle, less than or equal to 30 degrees, to an imaginary plane defined by the outer surface 14 of the frame 16 when in an open position. It is most preferable for the outer surface 14 of the door 18 to be flush with the outer surface 14 of the frame 16 wherein the angle between the outer surface 14 of the door 18 and the imaginary plane is zero. Stated another way, the outer surface of the door 18 is parallel to the outer surface of the frame 16. (See FIG. 6). One of ordinary skill in the art would appreciate that FIGS. 3-6 are merely intended to schematically illustrate the open and closed conditions.

Figure 3:
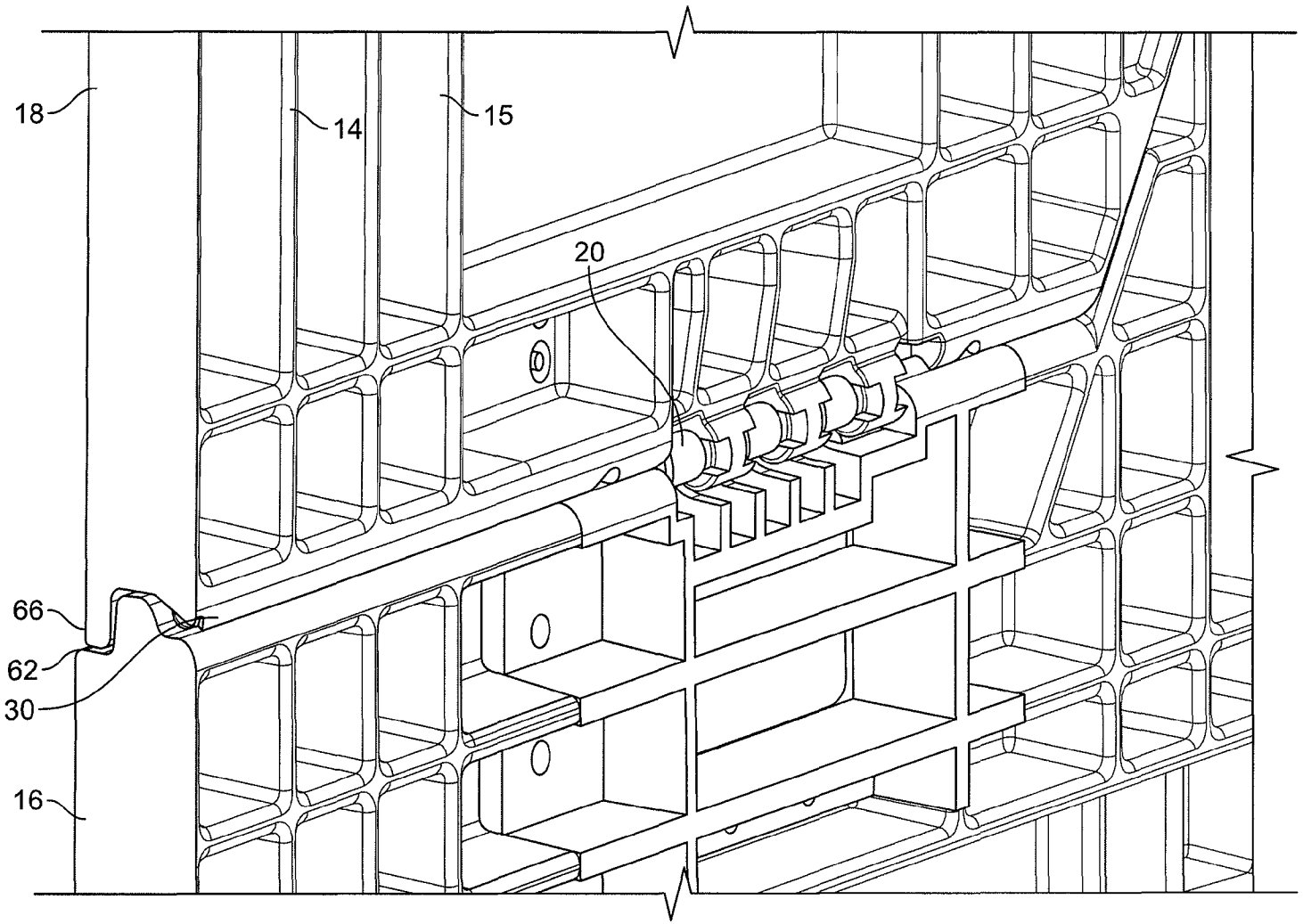
FIG. 3 is a partial perspective view of a bottom or outer surface of a panel of the present invention in a closed condition.

These door open and closed conditions are made possible by the hinge 20. The hinge 20 of the present invention is an extensible hinge 20. The extensible hinge 20 is preferably moveable along a linear path to provide clearance between the door 18 and the frame 16, but may move along an arc if desired. This clearance allows the door 18 to lie at the very low angle, preferably parallel to the outer surface 14 of the remaining panel 10. A comparison of FIG. 3 to FIGS. 4 and 5, illustrates the extensible hinge 20 as it is withdrawn or extended outwardly from the frame 16.

The extensible hinge 20 has a pivot pin attachment mechanism to join the hinge 20 to the door 18. Accordingly, the hinge 20 has receivers 24 which mate with receivers 28 located on an edge portion 30 of the door 18. In mating relationship, the receivers 24,28 form a passageway through which a pin 32 is received to join the hinge 20 to the door 18. A pivoting axis is defined by the pin 32.

The extensible hinge 20 is joined to the frame 16. Although any number of attachment means which allow the hinge 20 to slide relative to the frame may be used, the hinge 20 is preferably joined to the frame 16 by spring-loaded keepers 36 located on opposite ends of the hinge 20. The keepers 36 are inserted through openings 40 in the frame 16 and cooperate with extensions or shelf members 44 to retain a portion of the hinge 20 within the frame 16 between the inner and outer surface 12,14 of the panel 10. This arrangement allows the hinge 20 to extend outwardly from the frame 16 but prevents over-travel of the hinge 20, removing the possibility of the hinge 20 being undesirably detached from the frame 16. Thus, the keepers 36 ensure attachment of the extensible hinge 20 to the frame 16.

The hinge 20 further includes an extensible plate or tongue 48 spaced a distance from the pivot axis. This plate 48 is inserted within a slot 52 located on the frame 16. The plate 48 is extendable from the frame 16 from a first position wherein the pivot axis is at least partially adjacent a first side of an imaginary plane defined by the outer surface 14 of the frame 16 to a second position wherein the pivot axis is located on an opposite side of the imaginary plane. Preferably, the slot 52 has a length sufficient to allow the entirety of the hinge 20 to be located between the inner and outer surfaces 12,14 of the panel 10. A width of the slot 52 prevents excessive transverse shifting of the plate 48 within the slot 52, and a height of the slot 52 is sufficient to allow the plate 48 to traverse the length of the slot 52 without requiring excessive force while at the same time minimizing and/or eliminating longitudinal shifting of the plate 48 within slot 52. Guides 56 located on a surface of the plate 58 further serve to stabilize the plate 48 within the slot 52. The guides 56 may engage portions of the panel 10 to restrict transverse and/or longitudinal shifting during hinge 20 extension from the slot 20.

The slot 52 may have an arc-shape, but is preferably angled relative to the imaginary plane defined by the outer surface 14 of the panel 10. The angle of the slot 52 fixes an angle at which the hinge 20 is extendable from the frame 16. The fixed angle is generally less than or equal to 90 degrees and is preferably less than 90 degrees to allow both a horizontal and a vertical component to displacement of the edge portion 30 of the door 18 as the hinge 20 is extended from the frame 16.

It is contemplated that the slot 52 be sized to enable traverse of the plate 48 (extension and retraction of the hinge 20) within the slot 52 without excessive motion restricting friction. Therefore, a person of ordinary skill in the art would readily recognize that the slot 52 restricts operational motion to linear movement in two-dimensions although some non-operational movement may occur due to the limitations of manufacturing tolerances.

The extensible hinge 20 is selectively extended from the slot 52 as the door 18 is rotated about the pivoting axis. This extension is controlled by contact between a portion of the door 20 with a portion of the frame 16. Preferably, the frame 16 and/or door 18 have extensions which are cooperatively engaged as the door 18 rotates about the pivoting axis, causing a reciprocal movement of the hinge 20 outwardly from the slot 52, increasing a distance between a first end portion 62 of the frame 16 and a first end portion 66 of the door 18 in response to engagement between the frame 16 and the door 18. Preferably, the door 18 has a cam surface 70 engageable with a surface 74 of the frame 16 member wherein engagement of the cam surface 70 with the surface 74 during rotation of the door 18 about the pivot axis causes reciprocal movement by the extensible hinge 20 withdrawing a portion of the plate 48 from the slot 52 and increasing the distance between the first end portion 62 of the frame 16 and the first end portion 66 of the door 18. This increasing distance is best illustrated in FIGS. 3-6, while the cam surface 70 and the surface 74 of the frame 16 are best illustrated on FIG. 10.

A clearance 76 is provided adjacent the cam surface 70. The clearance appears as a discontinuity or cut out. The clearance allows a space for the pin 32 to be installed through the receivers 24, 28 in the hinge 20 and door 18, respectively.

It should be further noted that the door 18 includes a pair of extensions 78 located on opposing sides of the hinge 20. These extensions 78 are recessed within cutouts 80 on the frame 16 when the panel 10 is in the closed condition. (See FIGS. 1, 2, 10). These extensions 78 ride on the surfaces 74 as the door 18 goes from the closed condition to the open condition, preventing the door 18 from binding against edge portions of the frame 16. Guides 84 on the surface 74 further prevent the extensions 78 from stabbing into the edge portion near the outer surface 14 of the frame 16. The extensions 78 and cutouts 80 allow the panel 10 and manual opening tolerances to enjoy a wider range such that the door 18 can be placed in the open condition without being elevated out of position.

Another embodiment of the present invention is illustrated in FIGS. 16-20. In this embodiment, several components have been added to the hinge 20 and the panel 10 to provide increased stability and usability. The panel 10 of this embodiment differs from the previously described embodiment in the ways specifically set out in the description. It follows that the various components of the panel 10 embodiments (i.e., the frame, the door, and the hinge) are interchangeable, and one of ordinary skill in the art would immediately appreciate that fact.

Figure 16:
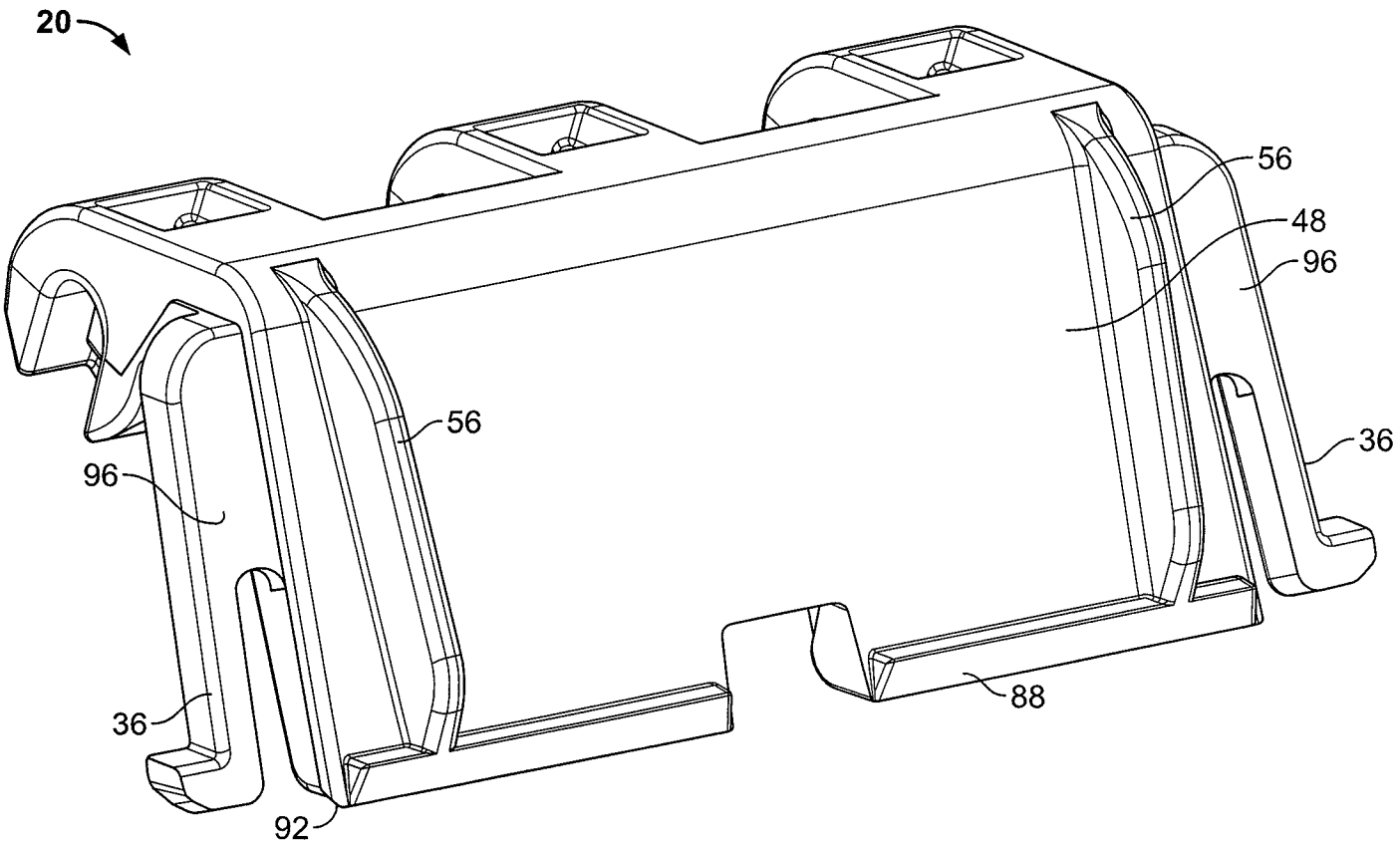
FIG. 16 is a perspective of a rigid, slideable, articulated hinge.
Figure 17:
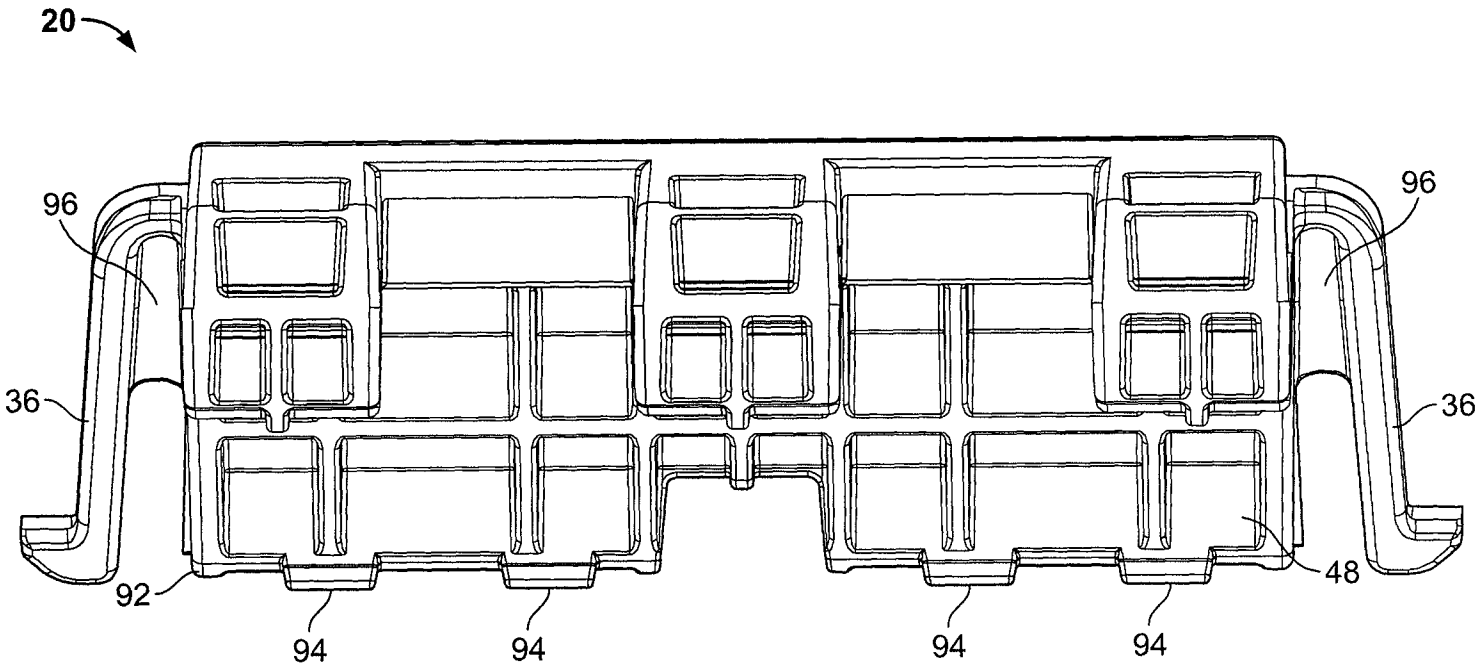
FIG. 17 is an alternate view of the hinge of FIG. 16.

Referring to FIGS. 16-17, the hinge 20 of this embodiment preferably includes a transverse rib or step 88 adjacent a trailing edge 92 of the extensible plate 48 to help hold the hinge 20 in the open side part when the drop door 18 is opened with force. This step 88 is extends outwardly from the plate 48 and is preferably tapered having a narrow portion along the trailing edge 92 of the hinge 20, and a wider portion opposite the narrow portion and spaced from the narrow portion by an angled segment joining the narrow and wider portions.

Further, transverse ribs 94, preferably four ribs, have been added to the plate 48 on an opposing side of the plate 48 to tighten the fit within the slot 52 in the open side to help hold the step 88 snug or tight against the slot 52. The transverse ribs 94 extend outwardly from the plate 48 in a direction opposite to the extension of the step 88. The ribs 94 are further angled to extend slightly beyond the trailing edge 92 of the plate 48, thus widening the plate 48 are those locations.

A pair of gussets 96 have been extended down on each end to stiffen the spring-loaded keepers or snap fingers 38 at each end of the hinge 20. Further strengthening members 98 can be added to the hinge 20 for increased stiffness of the area between the hinge rod lugs.

Figure 18:
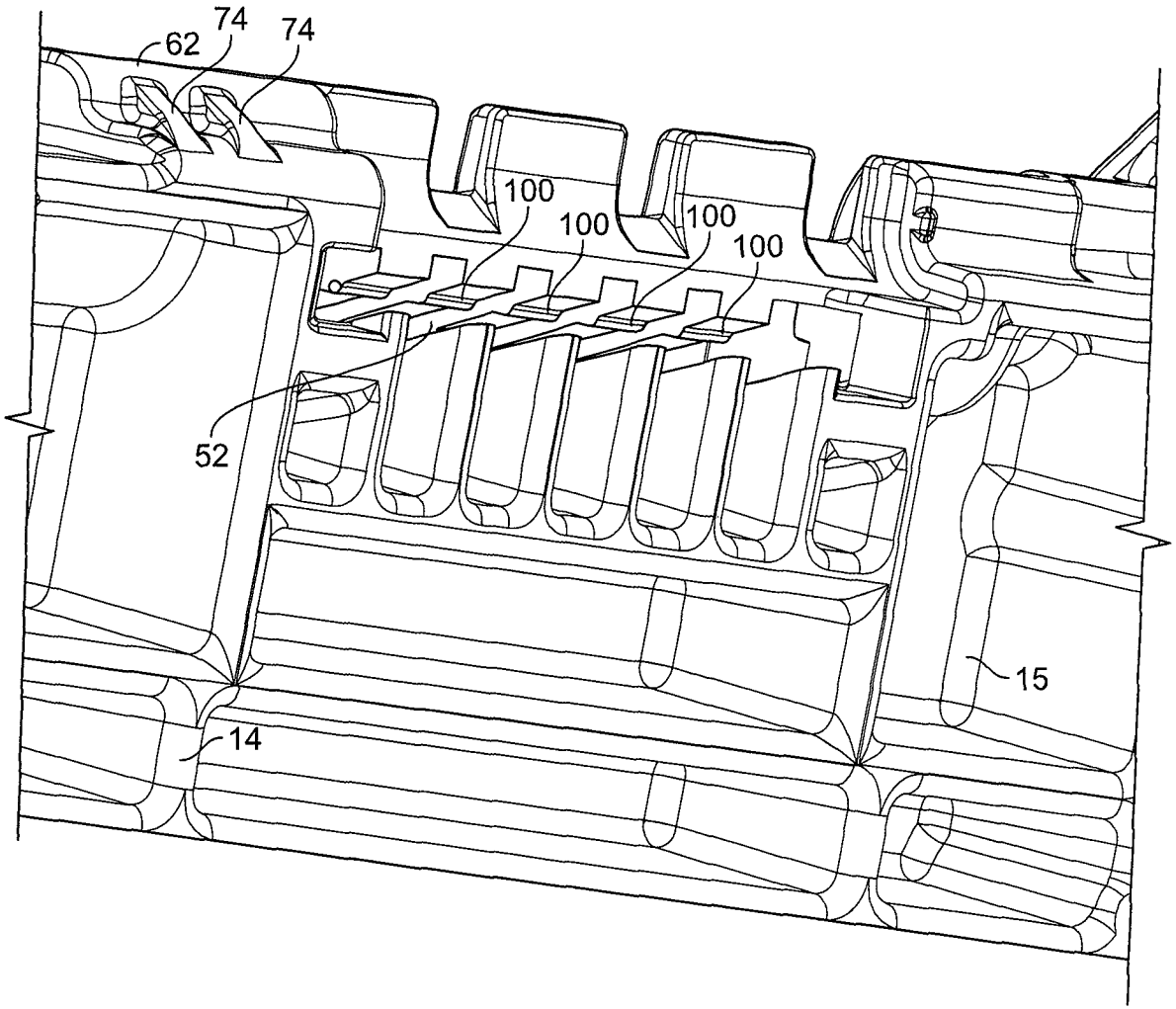
FIG. 18 is a magnified perspective view of the a portion of a frame to which a door is hingedly attached.
Figure 19:
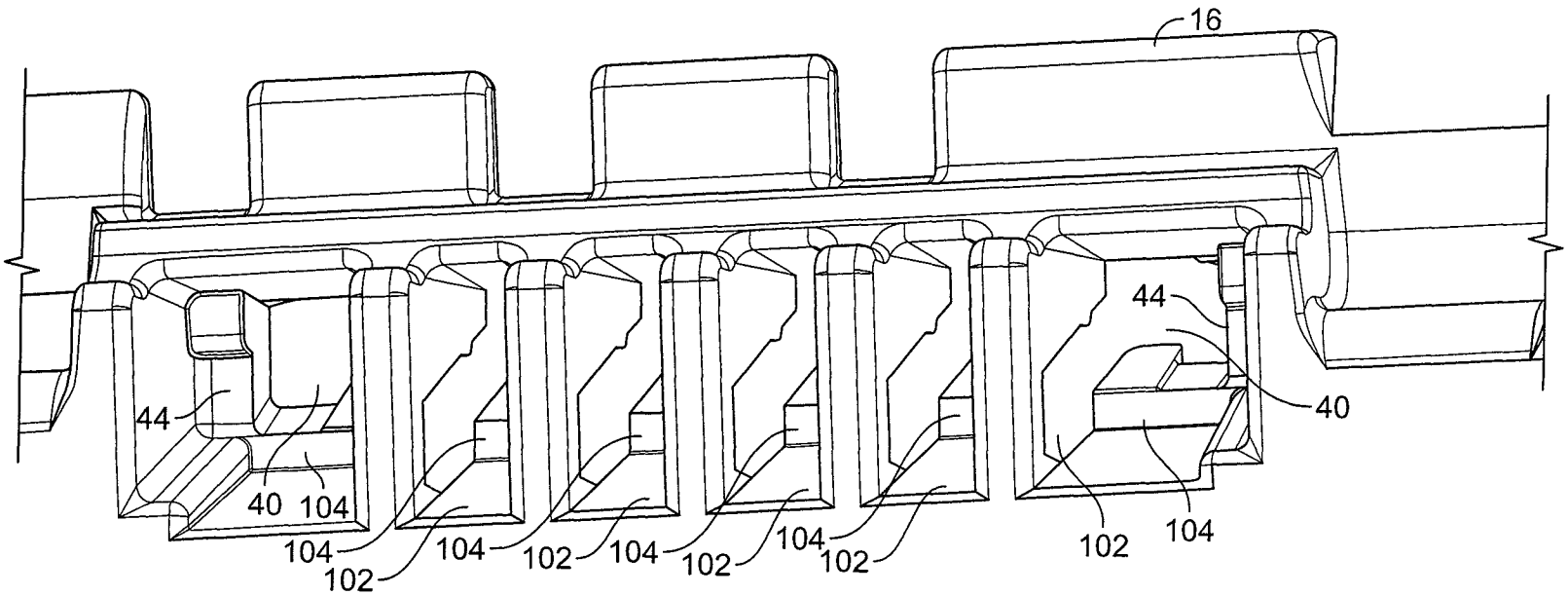
FIG. 19 is a top or inner surface magnified view of the portion of the frame shown in FIG. 18.

As illustrated in FIGS. 18-19, the slot 52 in the panel 10 preferably includes one or more detents 100 or outwardly extending projections. These detents 100 cooperate with the ribs 94 and the step 88 to help hold the hinge 20 snug in the open side of the panel 10. In other words, these detents 100 interact with the rib standoffs 94 and the step 88 added to the hinge 20.

Material has been removed from the slot 52 in six (6) places to form a space 102 to accept the step 88 and in which the step 88 traverses and an abutment 104 to engage the step 88 and to act as a stop to prevent unwanted movement by the hinge 20 within the slot 52. This helps hold the hinge 20 when the drop door 18 is opened and free falling. Two (2) small ribs have been removed from the outer surface 14 of the panel on both hinge pockets to facilitate movement of the hinge 20 and remove possible binding. (Compare FIGS. 11 and 18

Figure 20:
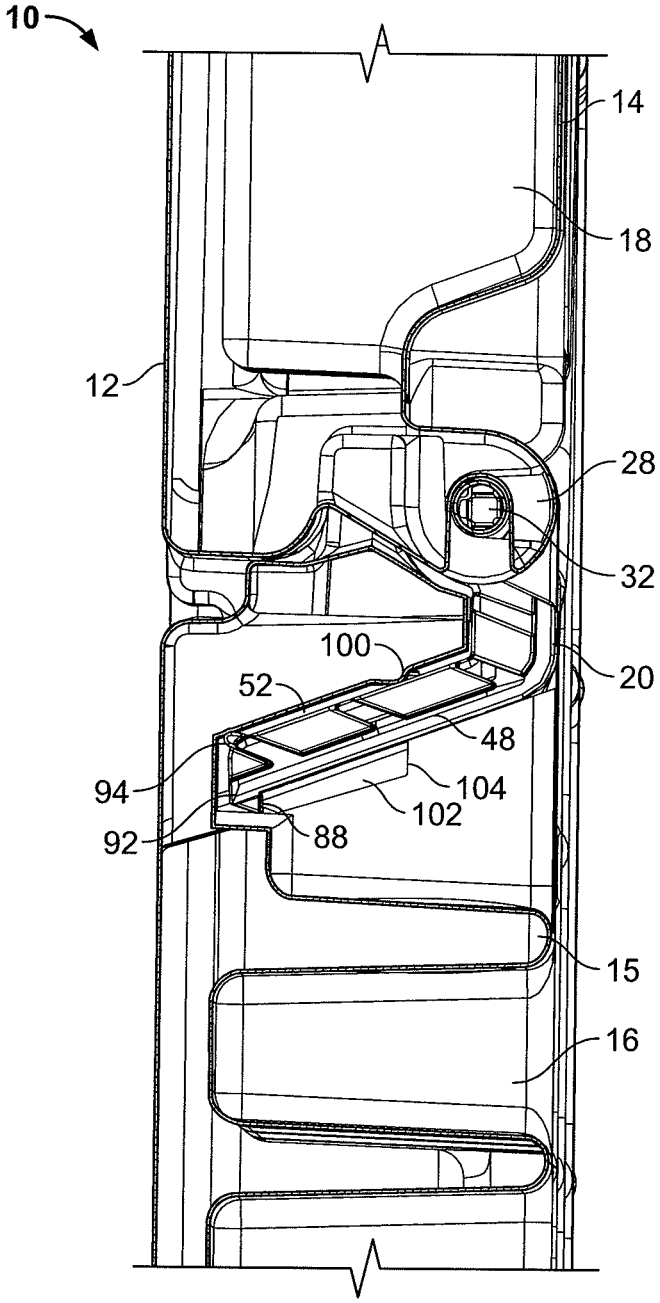
FIG. 20 is a partial cross-sectional view of a panel incorporating the hinge of FIGS. 16 and 17 with the frame of FIGS. 18 and 19.

The interaction between the alterations to the hinge 20 and the slot 52 are best shown in FIG. 20. The detent 100 added to the open side of the slot 52 cooperates with the with the standoff ribs 94 added on the hinge 20 to keep the hinge 20 against a lower edge of the slot 52 so the step 88 added to the hinge 20 moves within the space 102 and interlocks with the abutment 104 added to the open side of the slot 52.

While the specific embodiments have been illustrated and described, numerous modifications come to mind without significantly departing from the spirit of the invention, and the scope of protection is only limited by the scope of the accompanying Claims.

What is claimed is:

1. A hinge pivotally joining a first member to a second member, the hinge comprising:

a pivot axis defined by a pivot pin for attaching end portions of the first member and the second member; and an extensible plate attached to the first member and to the second member and located within an angled slot in the first member, the slot having an angle less than 90 degrees from an imaginary plane defined by an outer surface of the first member, the extensible plate and the pivot axis being selectively extendable from the slot in both horizontal and vertical components of displacement relative to the imaginary plane from a first position wherein the pivot axis is located on a first side of the imaginary plane to a second position wherein the pivot axis is located on an opposite side of the imaginary plane.

2. The hinge of claim 1 further comprising:

a keeper engageable with a portion of the first member to retain the hinge to the first member.

3. The hinge of claim 2 wherein the keeper is spring-loaded.

4. The hinge of claim 1 wherein the pivot axis is spaced a distance from the extensible plate.

5. The hinge of claim 1 further comprising:

a receiver for receiving the pivot pin therethrough spaced from the extensible plate; and a spring-loaded keeper engageable with the first member to retain the hinge thereto.

6. A modular bulk container panel, the modular bulk container panel comprising:

a frame having a first frame surface defining a first imaginary plane and an opposing second frame surface defining a second imaginary plane substantially parallel to the first imaginary plane;

a door having a first door surface; and an extensible hinge pivotally joining the door with the frame, the hinge having a single pivoting axis and being movable from a first position in the door closed condition wherein the pivoting axis is entirely located between the first imaginary plane and the second imaginary plane and the first door surface is substantially co-planar with the first imaginary plane to a second position located outwardly from the first position in a door open condition and the first imaginary plane wherein the pivoting axis is no longer located between the first and second imaginary planes wherein an angle between the first imaginary plane and the first door surface is less than 30 degrees.

* * * * *